US006012866A

United States Patent [19]

Podosek

[11] Patent Number: 6,012,866

[45] Date of Patent: Jan. 11, 2000

[54] SHEET PROTECTOR

[75] Inventor: Edward Podosek, Wilbraham, Mass.

[73] Assignee: Avery Dennison Corporation, Pasedena, Calif.

[21] Appl. No.: 09/022,142

[22] Filed: Feb. 11, 1998

Related U.S. Application Data

[60] Provisional application No. 60/065,005, Nov. 10, 1997, provisional application No. 60/043,028, Apr. 15, 1997, provisional application No. 60/037,708, Feb. 12, 1997, and provisional application No. 60/040,245, Feb. 11, 1997.

[51] Int. Cl.[7] ..... B42F 13/00

[52] U.S. Cl. ..... 402/79; 281/38

[58] Field of Search ..... 402/79, 80 R; 281/38, 45, 28, 29, 31; 283/107, 109; 353/120

[56] References Cited

U.S. PATENT DOCUMENTS

| | | | |
|---|---|---|---|
| 4,784,508 | 11/1988 | Shannon | 402/79 |
| 4,810,544 | 3/1989 | Hickman | 402/79 X |
| 4,925,720 | 5/1990 | Hansen | 402/79 |
| 5,335,027 | 8/1994 | Lin et al. | 402/79 X |

*Primary Examiner*—Willmon Fridie, Jr.
*Attorney, Agent, or Firm*—Kriegsman & Kriegsman

[57] ABSTRACT

In one embodiment, a sheet protector for holding a paper document comprises a sheet of transparent material, such as plastic, which is folded over on itself about a vertical fold line to form a front panel and a rear panel. The front and rear panels are identical in size and shape and each include a top edge, a bottom edge, a right side edge and a left side edge, the vertical fold line defining the right side edge of the front panel and the left side edge of the rear panel. The front and bottom panels are secured together along their bottom edges by a horizontal weld line. The top and bottom panels are additionally secured together at a location in close proximity the side edges opposite the vertical fold line by a first vertical weld line. Together the vertical fold line, the horizontal weld line and the first vertical weld line define a generally rectangular shaped pocket between the front and rear panels into which the paper document can be inserted. A vertical cut line extends down from the top edge of the front panel to enable a portion of the front panel to be folded open to enable the paper document to be easily inserted into the generally rectangularly shaped pocket. In another embodiment, the first vertical weld line comprises a bottom portion of increased thickness. As such, the vertical cut line separates the bottom portion of the first vertical weld line into an inner weld line and an outer weld line, the inner weld line serving to retain paper documents within the generally rectangular pocket. In another embodiment, the top and bottom panels are additionally secured together by a second vertical weld line which extends up from the horizontal weld line approximately ¾ of an inch. The second vertical weld line serves to trap the paper document within the generally rectangular pocket.

17 Claims, 9 Drawing Sheets

SHEET PROTECTOR

CROSS-REFERENCE TO RELATED APPLICATIONS

This application claims the benefit of U.S. Provisional Application No. 60/065,005, filed on Nov. 10, 1997 U.S. Provisional Application No. 60/043,028, filed on Apr. 15, 1997, U.S. Provisional Application No. 60/037,708, filed on Feb. 12, 1997, and U.S. Provisional Application No. 60/040,245, filed on Feb. 11, 1997.

BACKGROUND OF THE INVENTION

The present invention relates to sheet protectors.

Sheet protectors are well known in the art and are commonly used as a protective covering for paper documents.

One well known type of sheet protector is manufactured by Avery Dennison Corporation of Pasadena, Calif. and is in the form of a pocket having an open top edge and closed side and bottom edges into which sheets of paper can be inserted through the open top edge. The sheet protector comprises a generally rectangular sheet of clear plastic material which is folded over on itself about a vertical fold line and welded closed on its bottom edge with a weld line and welded closed on the side opposite the fold line with a pair of spaced apart vertical weld lines. A strip of white plastic material is disposed in the area between the vertical weld lines. A plurality of holes are formed in the area between the vertical weld lines to enable the sheet protector and any documents held therewithin to be mounted on the rings of a binder without having to punch holes in the documents.

Although sheet protectors of the type described above are well known and widely used in commerce, one drawback of such a sheet protector is that paper documents can only be inserted into the protector through the open top edge. As a consequence, unless the paper documents are aligned perfectly along the open top edge, it is often difficult to slide the documents down and into the pocket of the sheet protector.

In U.S. Pat. No. 4,231,174 to Thompson there is disclosed a flat rectangular envelope having at least one wall which is transparent, the envelope in one form being fabricated from plastic film. Elongated mounting margins are formed along two side edges of the envelope, each having longitudinally spaced mounting apertures to enable the mounting of the envelope on a suitable support. The mounting apertures may be spaced to enable securing either edge of the envelope in a three-ring binder, or the envelope may be secured to other supports by means of ties. The mounting margins include some reinforcing means for improving the tear resistance of the mounting apertures. A plastic zipper is provided to close the top openable edge of the envelope. One wall may be formed from a magnetic material enabling the mounting of magnetic markers on the exterior of the transparent wall. The envelope may be secured to a rigid mounting board with coacting cords, which enable the envelope to be flip-flopped on the board without removal from the board.

In U.S. Pat. No. 4,516,871 to Leitman there is disclosed a sheet protector formed of upper and lower layers of substantially transparent plastic material. A pair of complementary tabs each laterally extending from the edges of the respective layers are integrally formed therewith. Heat sealing is utilized for securing together at least some of the peripheries of the layers as well as the matching tabs. An opening is provided to define in combination with the layers a receiving pocket whereby a sheet may be inserted in the pocket. A looseleaf type binder is provided for holding a plurality of the sheet protectors. The tab positions of the respective sheet protectors in the binder are sequentially indexed with respect to each other to provide a set of position selectable sheet protectors.

In U.S. Pat. No. 3,736,685 to Shibata there is disclosed an adhesive sheet material for mounting items in albums, scrapbooks and the like. The sheet material comprises an adhesive backing sheet and a transparent protective sheet. A suitable pattern of pressure sensitive adhesive films is printed on the backing sheet, leaving a certain amount of unprinted areas which are substantially lower than the printed portions.

In U.S. Pat. No. 3,670,434 to Shibata et al there is disclosed an adhesive sheet device for mounting photographs and other display items in albums, scrapbooks and the like. The device includes a relatively thick backing sheet and a relatively thin film of pressure-sensitive adhesive coating one surface of the backing sheet. A substantially uniplanar cover sheet of transparent material is disengageably adhered to the coated surface of the backing sheet for insertion of an item beneath the cover sheet for clear viewing of the item through the transparent cover sheet. The backing sheet is provided with means for eliminating the tendency of the sheet to buckle or warp when the cover sheet is repeatedly engaged with and disengaged from the backing sheet under pressure.

In U.S. Pat. No. 4,635,796 to Ozeki there is disclosed a film jacket for strip films comprising a surface sheet, a back sheet and a pair of locating means each consisting of at least two welded portions as a unit which are separated from each other in the width direction of the strip film at a distance slightly larger than the width of the strip film, said pair of the locating means being separated from each other in the length direction of the strip film pocket and said welded portions constituting a film pocket for holding a strip film therein. The welded portions of the paired locating means on either one of the upper and lower sides of the film pocket may be united together to form a short or long welded portion which is positioned between the welded portions on the other side of the film pocket.

SUMMARY OF THE INVENTION

It is an object of the present invention to provide a new and improved sheet protector.

It is another object of the present invention to provide a sheet protector of the type described above which allows for paper documents to be easily inserted into and easily removed therefrom.

It is yet another object of the present invention to provide a sheet protector of the type described above which is constructed of a transparent material.

It is still another object of the present invention to provide a sheet protector of the type described above which comprises a plurality of holes that enable the sheet protector to be mounted in a ring-type binder.

It is yet still another object of the present invention to provide a sheet protector of the type described above which has a limited number of parts, is inexpensive to manufacture and is easy to use.

Accordingly, there is provided a sheet protector for holding a paper document, said sheet protector comprising a sheet of transparent material which is folded over on itself about a vertical fold line to form a front panel and a rear panel, each of the panels having a top edge, a bottom edge, a right side edge and a left side edge, the vertical fold line defining the right side edge of the front panel and the left side edge of the rear panel, a first weld line for securing together the front and rear panels along their bottom edges, a second weld line for securing together the front and rear panels at a location in close proximity and parallel with the side edges opposite the vertical fold line, the vertical fold line, said first weld line and said second weld line together defining a generally rectangular shaped pocket between the front and rear panels into which the paper document can be inserted, the pocket having an opening along the top edge of the front and rear panels, and a vertical cut line formed on the front panel for enabling a portion of the front panel to be folded open so as to enable said paper document to be easily inserted into said generally rectangularly shaped pocket, said vertical cut line extending down from the top edge of the front panel.

There is also provided a sheet protector for holding a paper document, said sheet protector comprising a sheet of transparent material which is folded over on itself about a vertical fold line to form a front panel and a rear panel, each of the panels having a top edge, a bottom edge, a right side edge and a left side edge, the vertical fold line defining the right side edge of the front panel and the left side edge of the rear panel, a first weld line for securing together the front and rear panels along at least a portion of their bottom edges, and a second weld line for trapping the paper document between the front and rear panels, said second weld line securing together the front and rear panels at a location in close proximity and parallel with the side edges opposite the vertical fold line.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate a prior art sheet protector and several different embodiments of a sheet protector constructed according to the present invention and, together with the description, serve to explain the principles of the invention. In the drawings wherein like reference numerals represent like parts.

DETAILED DESCRIPTION OF A PREFERRED EMBODIMENT

Figure 1A:
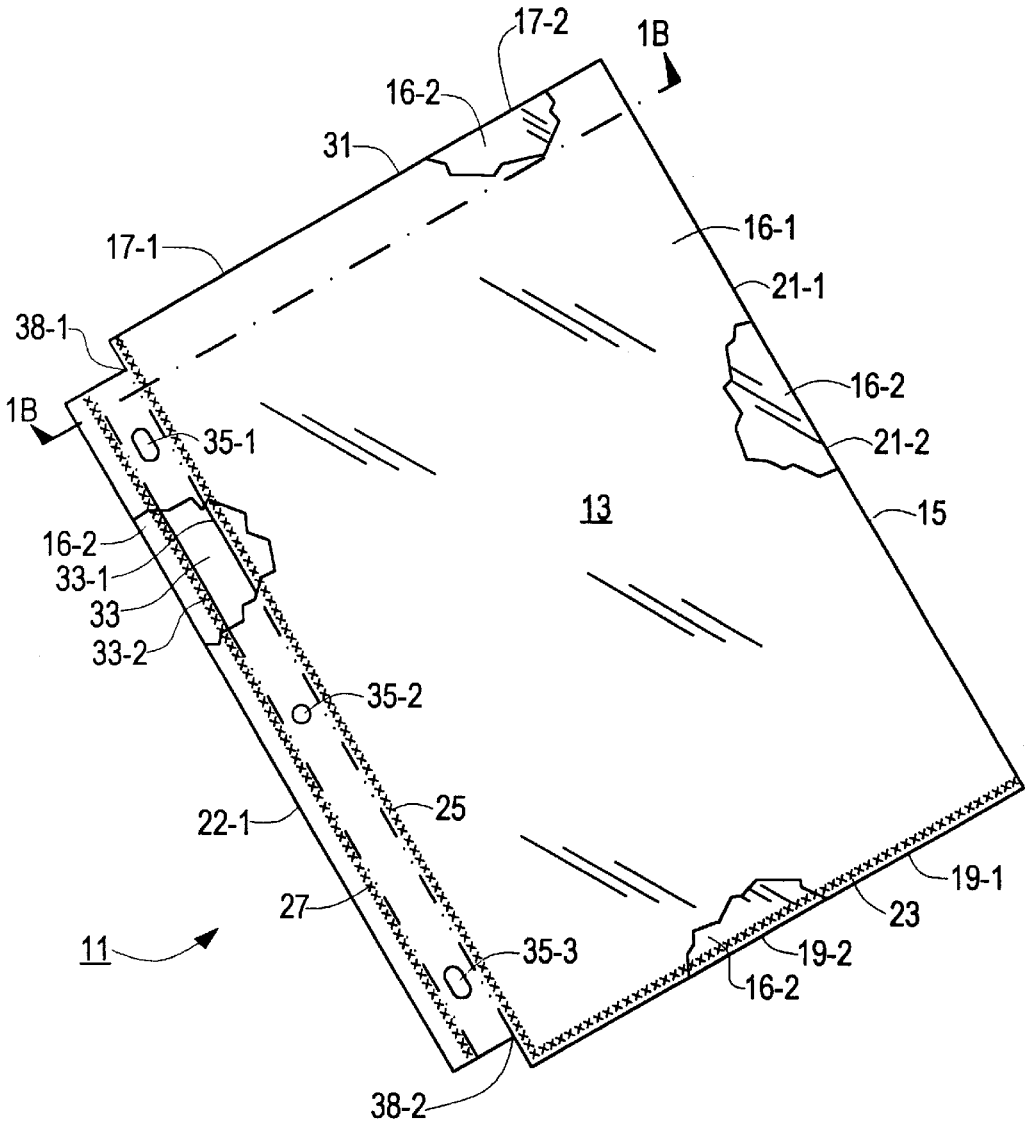
FIG. 1A PRIOR ART
FIG. 1A is a front plan view, broken away in parts, of a prior art sheet protector.

Referring now to FIG. 1A, there is shown a plan view, broken away in parts, of a prior art sheet protector, the prior art sheet protector being identified generally by reference numeral 11. Sheet protector 11 is well known in the art and is commonly used as a protective covering for objects such as paper documents which are insertable therewithin.

Sheet protector 11 comprises a sheet of transparent plastic material 13, such as clear polypropylene, which is folded over on itself about a vertical fold line 15 to form a front panel 16-1 and a rear panel 16-2, panels 16-1 and 16-2 being identical in size and shape. Front panel 16-1 includes a top edge 17-1, a bottom edge 19-1, a right side edge 21-1 which is defined by fold line 15 and a left side edge 22-1. Rear panel 16-2 includes a top edge 17-2, a bottom edge 19-2, a right side edge 21-2 defined by fold line 15 and a left side edge 22-2.

Front panel 16-1 and rear panel 16-2 are secured together along their bottom edges 19-1 and 19-2 by a horizontal weld line 23 and along their side edges 22-1 and 22-2 by a pair of spaced apart vertical weld lines 25 and 27. Weld lines 23 and 25 and fold line 15 form the sides and bottom of a generally rectangularly shaped pocket 29 between front panel 16-1 and rear panel 16-2, pocket 29 having an open top edge 31 through which sheets of paper documents (not shown) can be inserted. Weld lines 23, 25 and 27 can be formed using conventional welding techniques, such as ultrasonic or heat welding.

Sheet protector 11 also includes an elongated strip of colored plastic material 33, such as white polypropylene, having side edges 33-1 and 33-2. Strip 33 is disposed between front panel 16-1 and rear panel 16-2, between vertical weld lines 25 and 27. Plastic material 33 may have identifying markers (not shown) printed thereon, such as the corporate name of the manufacturer or the model name of the particular sheet protector.

Sheet protector 11 further includes a plurality of spaced apart mounting holes 35-1, 35-2 and 35-3 disposed between vertical weld lines 25 and 27, holes 35 extending through sheet 13 and strip 33. Holes 35 enable sheet protector 11 and any documents held therewithin to be mounted on the rings of a binder without having to punch holes in the documents, the holes being spaced from each other so as to align with the rings on the binder with which the sheet protector is to be used. The upper and lower left hand corners 38-1 and 38-2 of sheet protector 11 are notched, as shown.

Figure 1B:
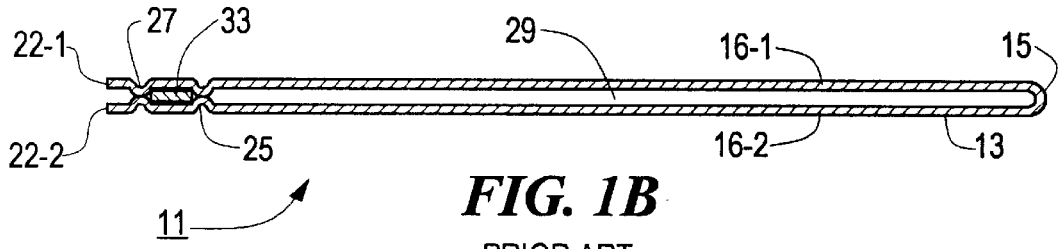
FIG. 1B PRIOR ART
FIG. 1B is a section view of the sheet protector of FIG. 1A, taken along lines 1B—1B in FIG. 1A.

A section view of sheet protector 11, taken along lines 1B—1B, in FIG. 1A is shown in FIG. 1B.

Figure 2A:
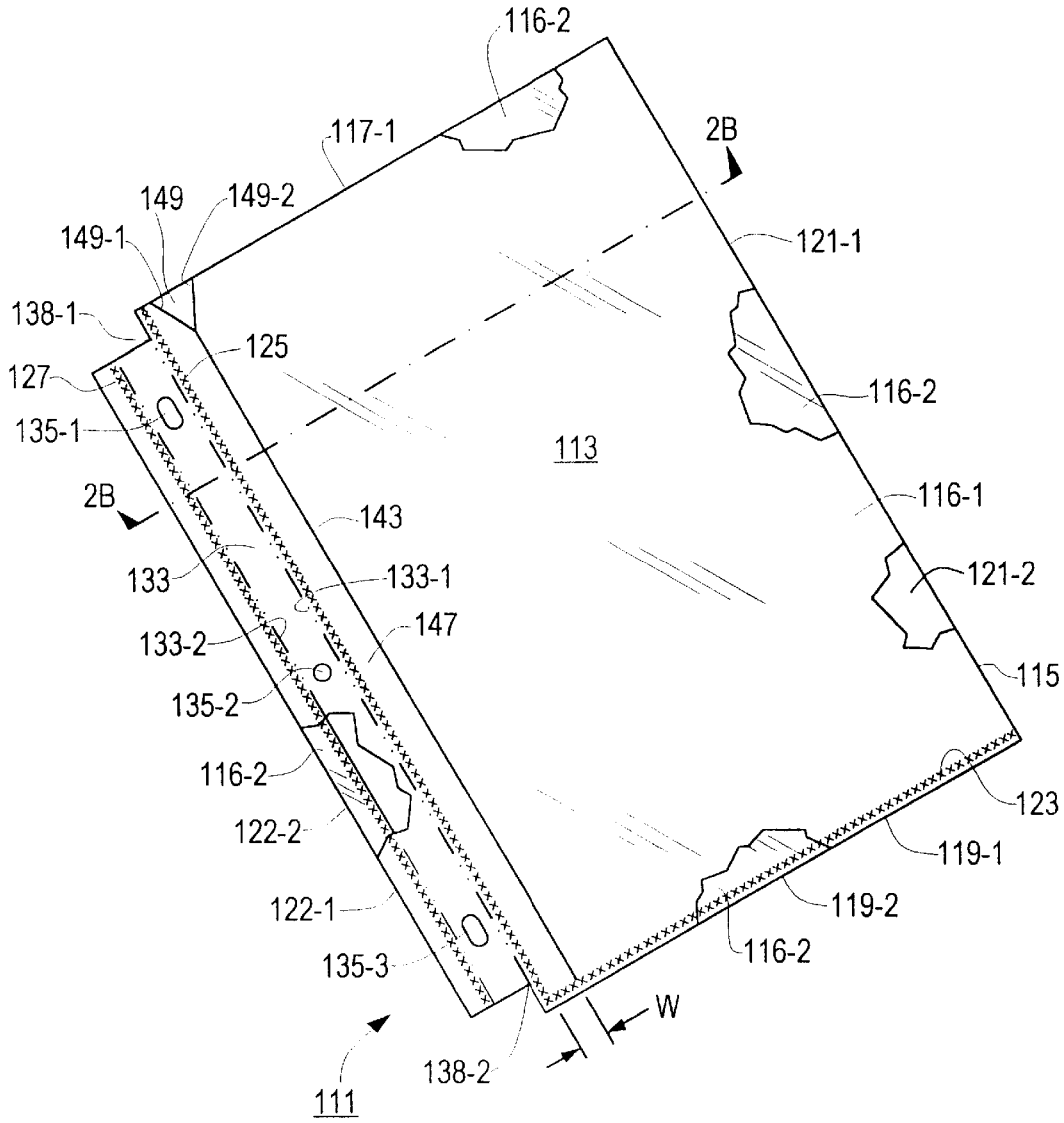
FIG. 2A is a front plan view, broken away in parts, of a first embodiment of a sheet protector constructed according to the teachings of the present invention.
Figure 2B:
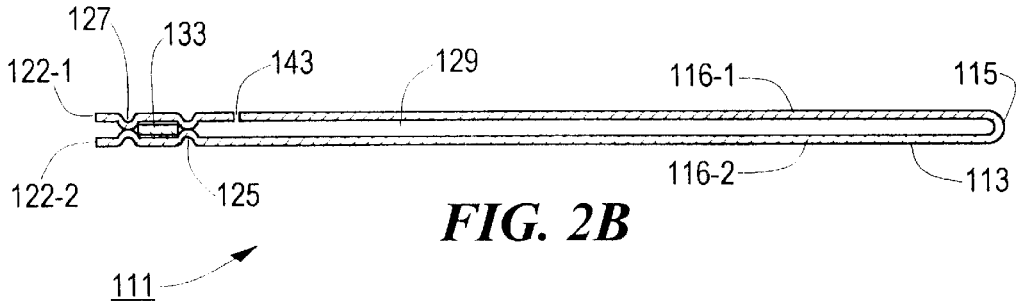
FIG. 2B is a section view of the sheet protector shown in FIG. 2A, taken along lines 2B—2B in FIG. 2A.
Figure 2C:
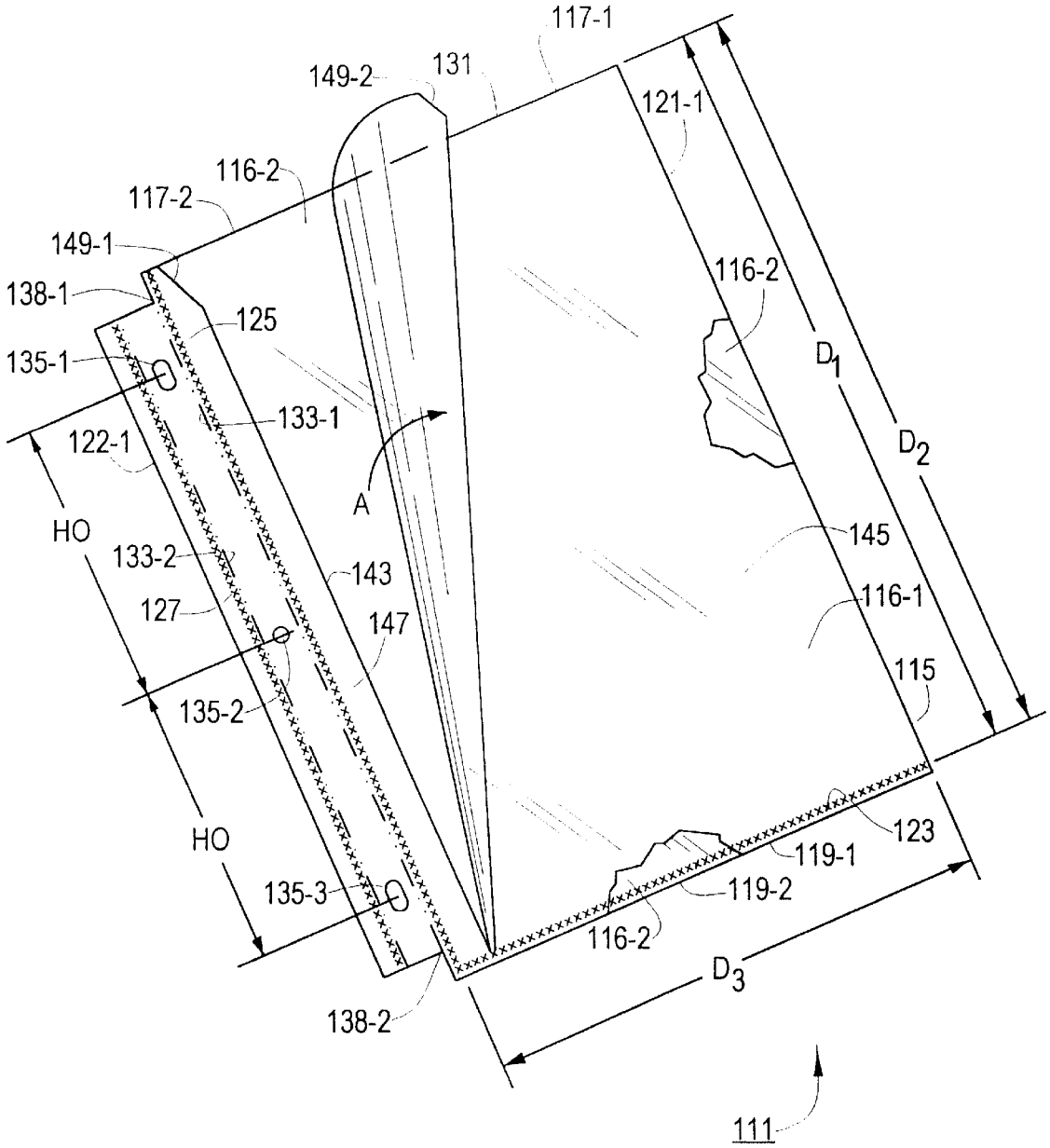
FIG. 2C is a front plan view of the sheet protector shown in FIG. 2A with a portion of the top panel partially folded over.

Referring now to FIGS. 2A through 2C, there is shown one embodiment of a sheet protector constructed according to the teachings of the present invention, the sheet protector being identified generally by reference numeral 111.

Sheet protector 111 is similar to prior art sheet protector 11 in that it comprises a sheet of clear plastic material 113, such as clear polypropylene, which is folded over on itself about a vertical fold line 115 to form a front panel 116-1 and a rear panel 116-2, panels 116-1 and 116-2 being identical in size and shape. Front panel 116-1 includes a top edge 117-1, a bottom edge 119-1, a right side edge 121-1 which is defined by fold line 115 and a left side edge 122-1. Rear panel 116-2 includes a top edge 117-2, a bottom edge 119-2, a right side edge 121-2 which is defined by fold line 115 and a left side edge 122-2.

Front panel 116-1 and rear panel 116-2 are secured together along their bottom edges 119-1 and 119-2 by a horizontal weld line 123 and along their side edges 122-1 and 122-2 by a pair of spaced apart vertical weld lines 125 and 127. Weld lines 123 and 125 and fold line 115 form the sides and bottom of a generally rectangularly shaped pocket 129 between front panel 116-1 and rear panel 116-2, pocket 129 having an open top edge 131. Weld lines 123, 125 and 127 can be formed using conventional welding techniques, such as ultrasonic or heat welding.

Sheet protector 111 is also similar to sheet protector 11 in that sheet protector 111 includes an elongated strip of colored plastic material 133, such as white polypropylene, strip 133 having side edges 133-1 and 133-2. Strip 133 is sandwiched between front panel 116-1 and rear panel 116-2, between vertical weld lines 125 and 127. Plastic material 133 may have identifying markers (not shown) printed thereon, such as the corporate name of the manufacturer or the model name of the particular sheet protector.

Sheet protector 111 is further similar to sheet protector 11 in that sheet protector 111 includes a plurality of spaced apart mounting holes 135-1, 135-2 and 135-3 disposed between vertical weld lines 125 and 127, holes 135 extending through sheet 113 and strip 133. Holes 135 enable sheet protector 111 and any documents held therewithin to be mounted on the rings of a binder without having to punch holes into the documents, holes 135 being spaced from each other to align with the rings on the binder with which sheet protector 111 is to be used. The upper and lower left hand corners 138-1 and 138-2 are also notched as in sheet protector 11.

Sheet protector 111 differs from sheet protector 11 in that sheet protector 111 additionally includes a vertical cut line 143 formed on front panel 116-1, vertical cut line 143 being spaced inward from vertical weld line 125. Vertical cut line 143 is shown as extending from top edge 117-1 of front panel 116-1 and down to horizontal weld line 123. However, vertical cut line 143 need not extend down the entire distance to horizontal weld line 123 but could, if desired, extend down only a part of the way from top edge 117-1 to horizontal weld line 123. Also, instead of being vertical, cut line 143 could be at an angle less than or greater than vertical.

Vertical cut line 143 splits front panel 116-1 into a generally rectangular portion 145 on the right and a thin retaining strip 147 on the left. Rectangular portion 145 can be folded open, as shown by arrow A in FIG. 2C, so as to enable paper documents to be easily inserted into rectangularly shaped pocket 129 from the front of sheet protector 141. The specific construction of front panel 116-1, namely, the provision of vertical cut line 143, greatly facilitates the ease in which one can insert paper documents into sheet protector 111 when compared to prior art sheet protector 11 which allows for paper documents to be loaded only down through open top 131. The top of vertical cut line 143, is shaped to form "v"-shaped notch 149, defined by edges 149-1 and 149-2, to assist in locating the top of rectangular portion 145, so that portion 145 can be easily grasped at vertical cut line 143 and folded over as shown. Retaining strip preferably has a width of between 1/16 of an inch and 3/8 of an inch.

Thin retaining strip 147 serves to held down the paper documents held within pocket 129 and thereby prevent the paper documents from slipping out of sheet protector 111 when rectangular portion 145 of front panel 116-1 is folded open to insert or remove documents. As an example only, a sheet protector according to the embodiment in FIGS. 2A through 2C constructed for use in holding one or more 8½ by 11 inch documents, may be sized such that the distance D1 from edge 117-1 to weld line 123 is 11 1/16 inches, the distance D2 from edge 117-1 to edge 119-1 is 11 3/16 inches, the distance D3 from edge 115 to weld line 125 is 8 5/8 inches, the hole spacing HO is 4¼ inches and thin retaining strip 147 has a width W of ¼ of an inch.

Figure 3A:
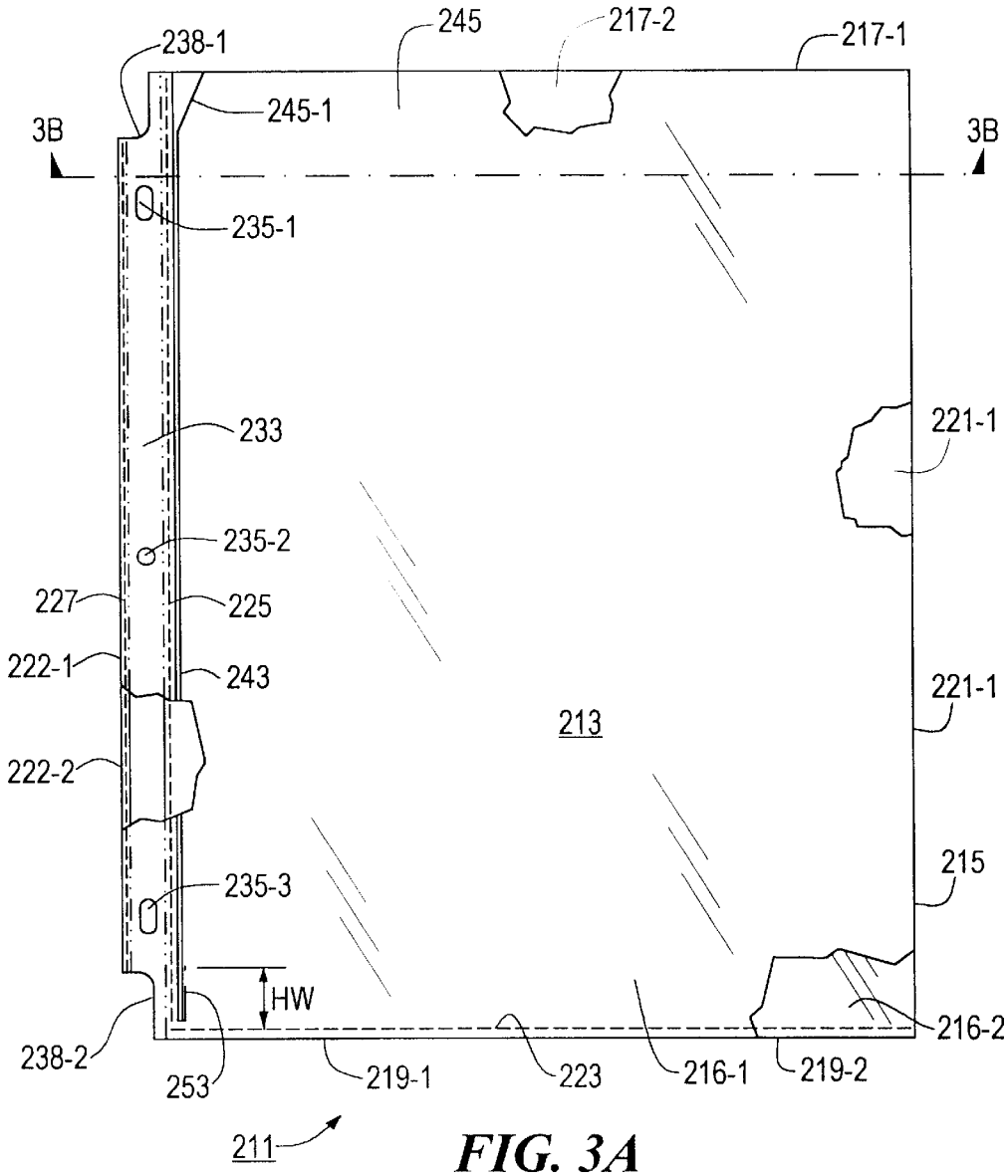
FIG. 3A is a front plan view, broken away in parts, of a another embodiment of a sheet protector constructed according to the teachings of the present invention.
Figure 3B:
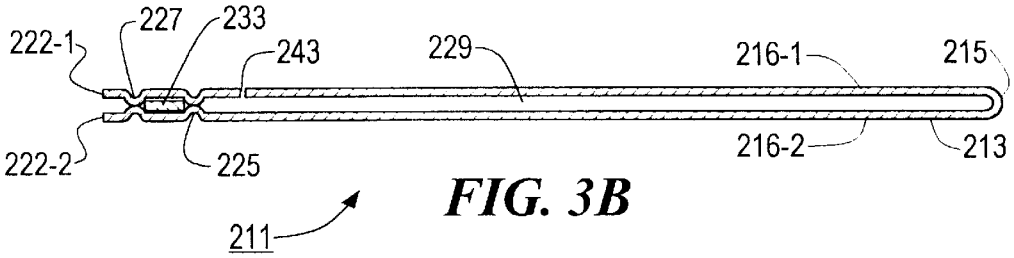
FIG. 3B is a section view of the sheet protector of FIG. 3A, taken along lines 3B—3B in FIG. 3A.
Figure 3C:
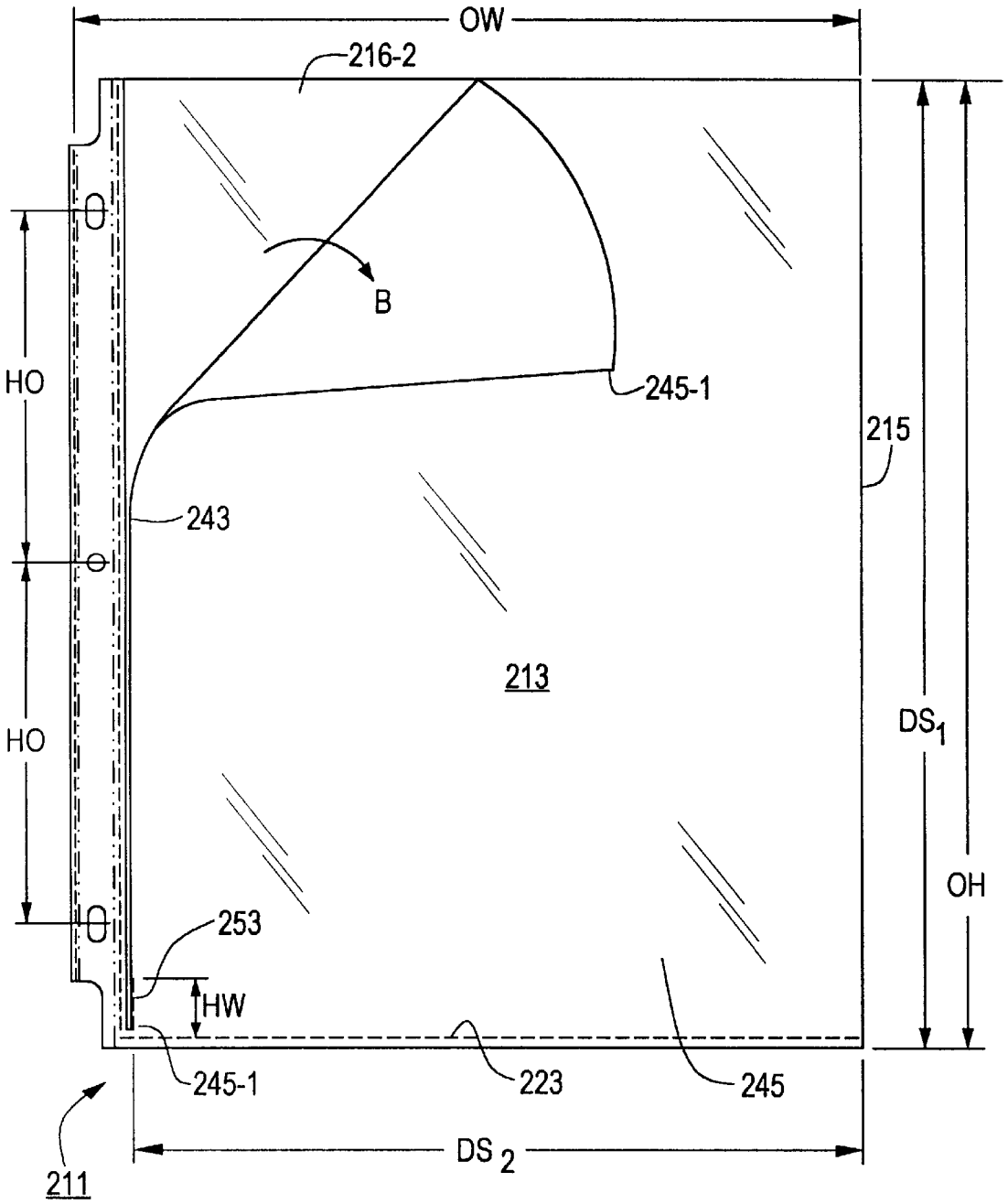
FIG. 3C is a front plan view of the sheet protector shown in FIG. 3A with a portion of the top panel partially folded over.
Figure 4A:
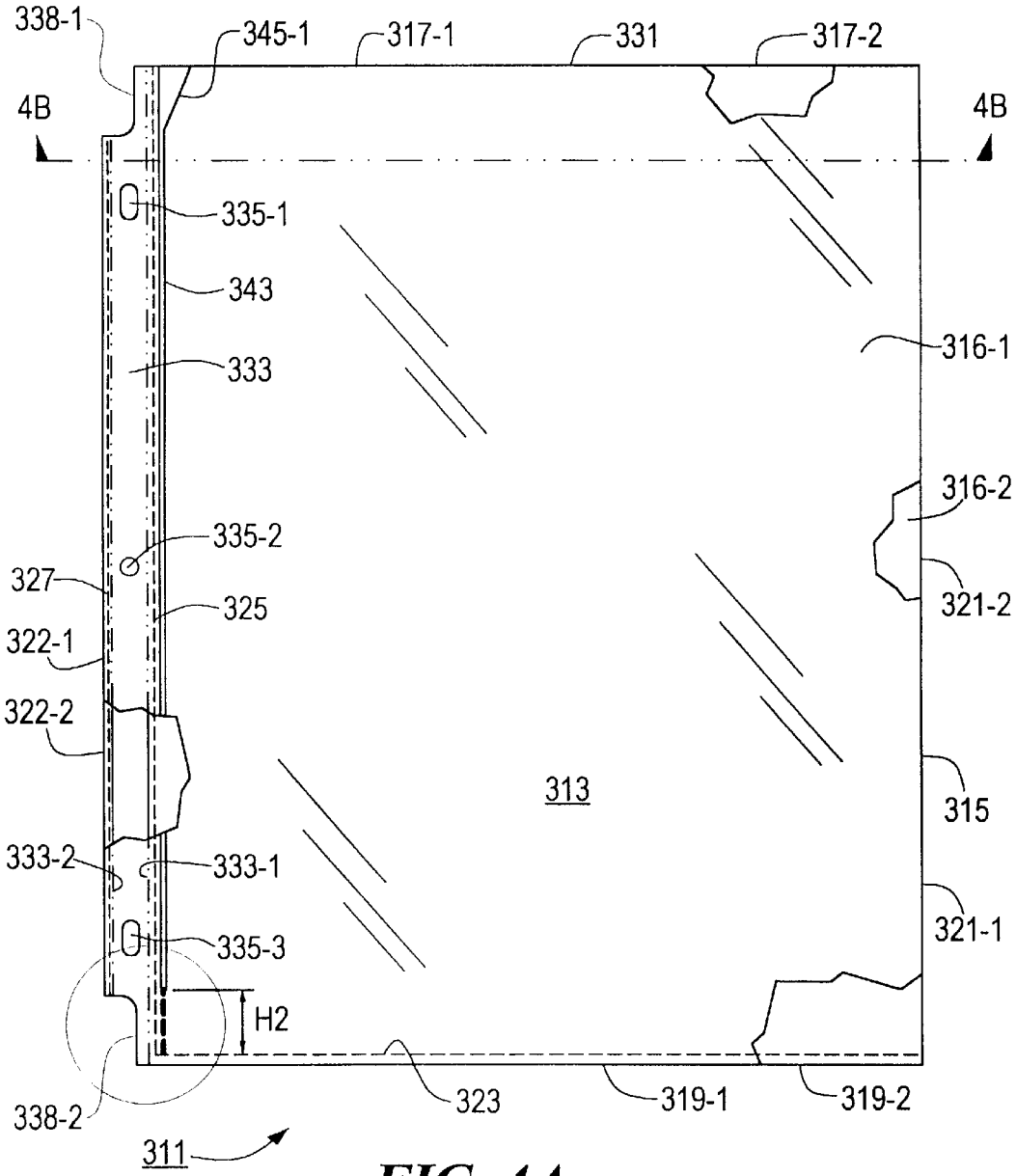
FIG. 4A is a front plan view, broken away in parts, of another embodiment of a sheet protector constructed according to the teachings of the present invention.
Figure 4D:
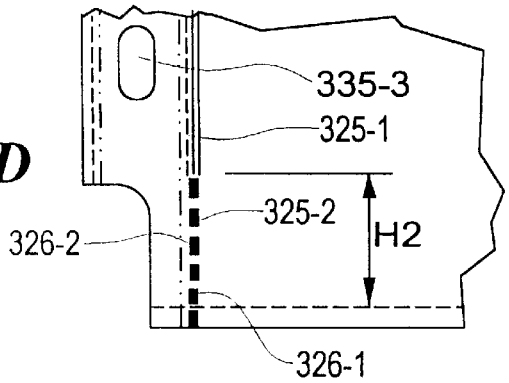
FIG. 4D is an enlarged fragmentary view of the circled area in FIG. 4C.
Figure 4C:
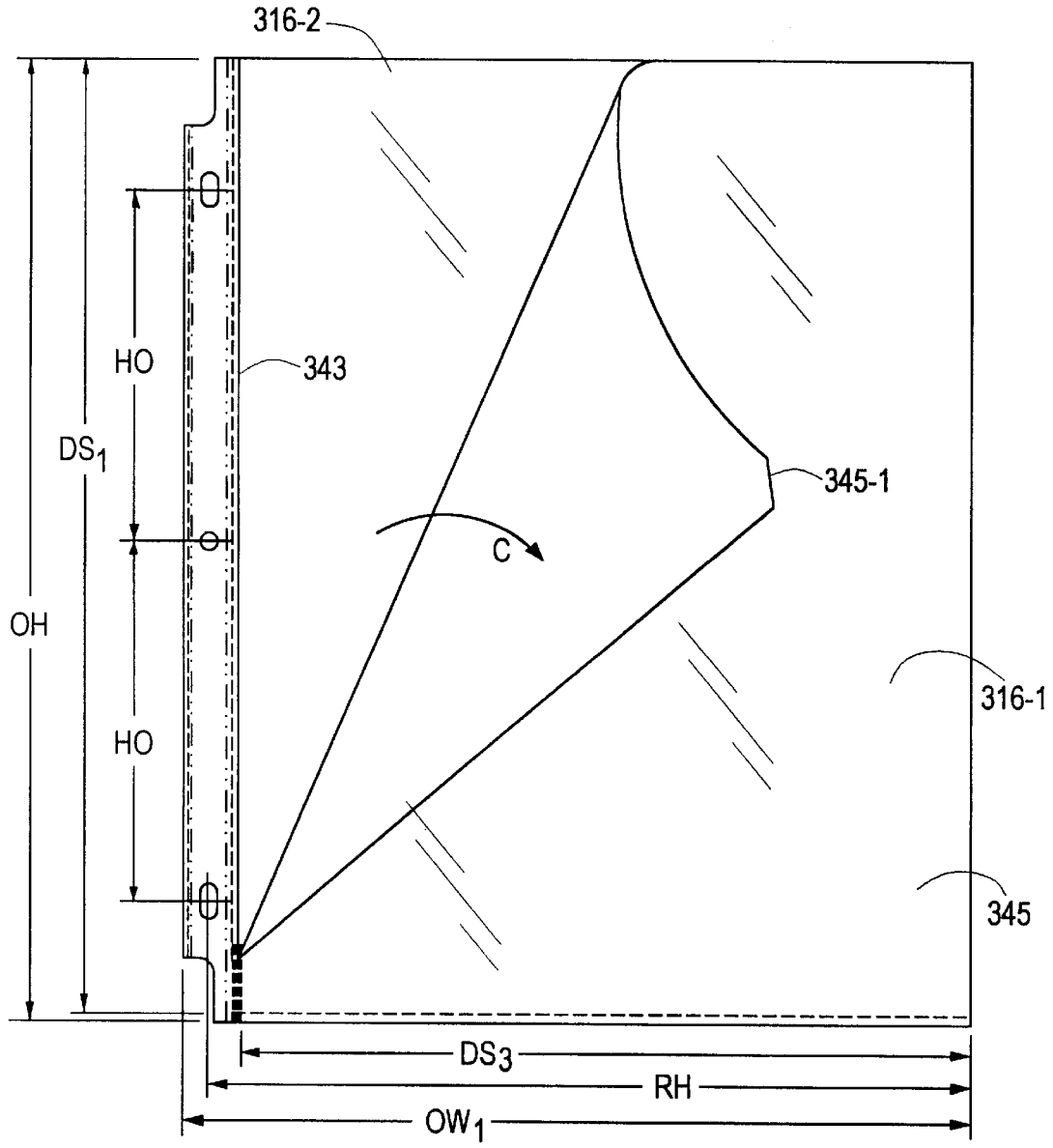
FIG. 4C is a front plan view of the sheet protector shown in FIG. 4A with a portion of the top panel partially folded over.
Figure 4B:
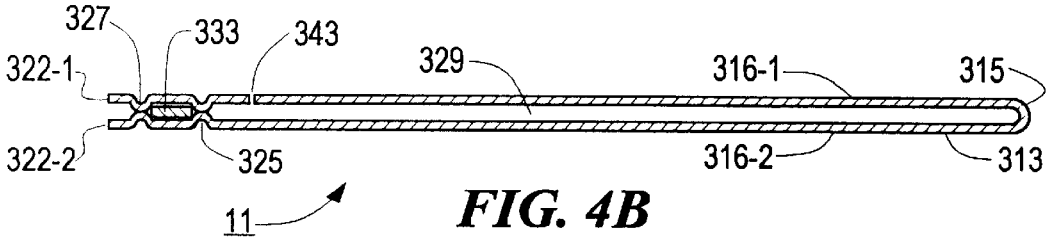
FIG. 4B is a section view of the sheet protector of FIG. 4A, taken along lines 4B—4B in FIG. 4A.

Referring now to FIGS. 3A through 3C, there is shown another embodiment of a sheet protector constructed according to the teachings of the present invention, the sheet protector being identified generally by reference numeral 211.

Sheet protector 211 is similar to sheet protector 111 in that it comprises a sheet of clear plastic material 213, such as clear polypropylene, which is folded over on itself about a vertical fold line 215 to form a front panel 216-1 and a rear panel 216-2, panels 216-1 and 216-2 being identical in size and shape. Front panel 216-1 includes a top edge 217-1, a bottom edge 219-1, a right side edge 221-1 which is defined by fold line 215 and a left side edge 222-1. Rear panel 216-2 includes a top edge 217-2, a bottom edge 219-2, a right side edge 221-2 defined by fold line 215 and a left side edge 222-2.

Front panel 216-1 and rear panel 216-2 are secured together along their bottom edges 219-1 and 219-2 by a horizontal weld line 223 and along their side edges 222-1 and 222-2 by a pair of spaced apart vertical weld lines 225 and 227. Weld lines 223 and 225 and fold line 215 form the sides and bottom of a generally rectangularly shaped pocket 229 between front panel 216-1 and rear panel 216-2, pocket 229 having an open top 231. Weld lines 223, 225 and 227 can be formed using conventional welding techniques, such as ultrasonic or heat welding.

Sheet protector 211 is also similar to sheet protector 111 in that sheet protector 211 includes an elongated strip of colored plastic material 233, such as polypropylene, disposed between front panel 216-1 and rear panel 216-2, between vertical weld lines 225 and 227. Plastic material 233 may have identifying markers (not shown) printed thereon, such as the corporate name of the manufacturer or the model name of the particular sheet protector.

Sheet protector 211 is further similar to sheet protector 111 in that sheet protector 211 includes a plurality of spaced apart mounting holes 235-1, 235-2 and 235-3 disposed between vertical weld lines 225 and 227, holes 235 extending through front panel 216-2, rear panel 216-2 and strip 233. Holes 235 enable sheet protector 211 and any documents held therewithin to be mounted on the rings of a binder without having to punch holes into the documents. The upper and lower left hand corners 238-1 and 238-2 are also notched as with sheet protector 111.

Sheet protector 211 is also similar to sheet protector 111 in that sheet protector 211 includes a vertical cut line 243 on front panel 216-1. However, instead of being spaced from weld line 225 so as to form a retaining strip, vertical cut line 243 is close to vertical weld line 225. Vertical cut line 243 is shown as extending from top edge 217-1 of front panel 216-1 and down to horizontal weld line 223. However, vertical cut line 243 need not extend down that entire distance but could, if desired, extend down only a part of the way from top edge 217-1 to horizontal weld line 223. Also, cut line 243 could be at an angle of less than or more than 90 degrees relative to top edge 217-1.

Vertical cut line 243 forms a generally rectangular portion 245 on front panel 216-1 which is capable of being folded open, as shown by arrow B, so as to enable paper documents to be easily inserted into rectangularly shaped pocket 229 from the front of sheet protector 211. The specific construction of front panel 216-1 greatly facilitates the ease in which one can insert paper documents into sheet protector 211 when compared to prior art sheet protector 11 which allows for paper documents to be loaded only through open top 31. The top left 245-1 of portion 245 is notched to assist in locating the top of rectangular portion 245 so that portion 245 can be easily grasped at vertical cut line 243 for opening.

Sheet protector 211 also differs from sheet protector 111 in that sheet protector 211 includes a third vertical weld line 253 (shown as a dash line in the drawing). Vertical weld line 253 serves to retain paper documents within pocket 229. Vertical weld line 253 is spaced apart from and in parallel with vertical cut line 243, vertical weld line 253 being positioned between fold line 215 and vertical cut line 243. Vertical weld line 253 is shown as extending up a height H of approximately ¾ of an inch from horizontal weld line 223. However, vertical weld line 253 could, if desired, have a height more than or less than ¾ of an inch while maintaining its functionality. Vertical weld line 253 welds the lower corner 245-1 of portion 245 to panel 216-2 and thus serves to trap paper documents within pocket 229 and prevent paper documents from slipping out of sheet protector 251 when rectangular portion 245 of front panel 216-1 is folded open to insert or remove documents.

As an example only, a sheet protector according to the embodiment in FIGS. 3A through 3C constructed for use in holding one or more 8½ by 11 inch documents, may be sized as follows, overall width OW is 9¼ inches, overall height OH is 11 3/16 inches, distance $DS_1$ from top edge 217 to horizontal weld line 223 is 11 1/16 inches, distance $DS_2$ from fold line 215 to weld line 253 is 8 9/16 inches, the height HW of weld line 253 is ¾ inches and the hole spacing HO is 4¼.

Referring now to FIGS. 4A through 4D, there is shown another embodiment of a sheet protector constructed according to the teachings of the present invention, the sheet protector being identified generally by reference numeral 311.

Sheet protector 311 is similar to sheet protector 211 in that it comprises a sheet of clear plastic material 313, such as clear polypropylene, which is folded over on itself about a vertical fold line 315 to form a front panel 316-1 and a rear panel 316-2, panels 316-1 and 316-2 being identical in size and shape. Front panel 316-1 includes a top edge 317-1, a bottom edge 319-1, a right side edge 321-1 which is defined by fold line 315 and a left side edge 322-1. Rear panel 316-2 includes a top edge 317-2, a bottom edge 319-2, a right side edge 321-2 defined by fold line 315 and a left side edge 322-2.

Front panel 316-1 and rear panel 316-2 are secured together along their bottom edges 319-1 and 319-2 by a horizontal weld line 323 and along their side edges 322-1 and 322-2 by a pair of spaced apart vertical weld lines 325 and 327. Weld lines 323 and 325 and fold line 315 form the sides and bottom of a generally rectangularly shaped pocket 329 between front panel 316-1 and rear panel 316-2, pocket 329 having an open top 331. Weld lines 323, 325 and 327 can be formed using conventional welding techniques, such as ultrasonic or heat welding.

Sheet protector 311 is also similar to sheet protector 211 in that sheet protector 311 includes an elongated strip of colored plastic material 333, such as white polypropylene, disposed between front panel 316-1 and rear panel 316-2, between vertical weld lines 325 and 327. Strip of material 333 may have identifying markers (not shown) printed thereon, such as the corporate name of the manufacturer or the model name of the particular sheet protector. Strip 333 includes side edges 333-1 and 333-2.

Sheet protector 311 is further similar to sheet protector 211 in that sheet protector 311 includes a plurality of spaced apart mounting holes 335-1, 335-2 and 335-3 disposed between vertical weld lines 325 and 327, holes 335 extending through sheet 313 and strip 333. Holes 335 enable sheet protector 311 and any documents held therewithin to be mounted on the rings of a binder without having to punch holes into the documents, the holes being spaced from each other so as to align with the rings on the binder with which the sheet protector is to be used. The upper and lower left hand corners 338-1 and 338-2 of sheet protector 311 are notched.

Sheet protector 311 is also similar to sheet protector 211 in that sheet protector 311 includes a vertical cut line 343 on front panel 316-1, vertical cut line 343 being spaced apart from and in parallel with vertical weld line 325. Vertical cut line 343 is shown as extending from top edge 317-1 of front panel 316-1 down to the bottom edge of sheet protector 311. However, vertical cut line 343 need not extend down that entire distance but could, if desired, extend down only a part of the way from top edge 317-1 toward the bottom edge of sheet protector 311.

Vertical cut line 343 forms a generally rectangular portion 345 on front panel 316-1. Rectangular portion 345 is capable of being folded open, as shown by arrow C in FIG. 4C, so as to enable paper documents to be easily inserted into rectangularly shaped pocket 329 from the front of sheet protector 311. The specific construction of front panel 316-1 greatly facilitates the ease in which one can insert paper documents into sheet protector 311 when compared to prior art sheet protector 11 which allows for paper documents to be loaded only through open top 331. The top corner 345-1 of portion 345 of notch 347 defined by side edges 347-1 and 347-2 to assist in locating the top of rectangular portion 345 so that portion 345 can be easily grasped at vertical cut line 343 for opening.

Sheet protector 311 differs from sheet protector 211 only in that vertical weld line 325 has a non-uniform width instead of the uniform width as with vertical weld line 225.

In particular, vertical weld line 325 comprises a top portion 325-1 having a width of a standard no. 10 rule, and a bottom portion 325-2 having a width 0.098 inches+/−0.005 inches. Bottom portion 325 of vertical weld line 325 extends up a height H2 of approximately ¾ of an inch from horizontal weld line 323. However, bottom portion 325-2 of vertical weld line 325 could, if could, if desired, have a different height H2 while maintaining its functionality.

Due to the large width of bottom portion 325-2 of weld line 325 and the position of weld line 325 relative to cut line 343, vertical cut line 343 which is formed on front panel 316-1 extends down from top edge 317-1, parallel to top weld portion 325-1 of weld line 325, goes through bottom portion 325-2 of weld line 325 and terminates at horizontal weld line 323. As such, vertical cut line 343 separates bottom portion 325-2 into an inner vertical weld line portion 326-1 and an outer vertical weld line postion 326-2, inner weld line 326-1 and outer weld line 326-2 being disposed on opposite sides of vertical cut line 343. Inner vertical weld line 326-1 functions similarly to vertical weld line 253 in sheet protector 211 in that inner vertical weld line 326-1 retains paper documents within pocket 329. Specifically, vertical weld line 326-2 serves to trap paper documents within pocket 329 and thereby prevent the paper documents from slipping out of sheet protector 311 when rectangular portion 345 of front panel 316-1 is folded open to insert or remove documents.

As an example only, a sheet protector according to this embodiment constructed for use in holding one or more 8½ by 11 inch documents, may be sized as follows, overall width $OW_1$ is 9¼ inches, overall height OH is 11 3/16 inches, distance $DS_1$ from top 331 to horizontal weld line 323 is 11 1/16 inches, distance $DS_3$ from fold line 215 to weld line 326-1 is 8 9/16 inches, the height $HW_2$ of weld line 326-1 from weld line 323 is ¾ inches the hole spacing HO is 4¼ and the distance RH from ring holes 335 to fold line 315 is 8 ⅞ inches.

Figure 5A:
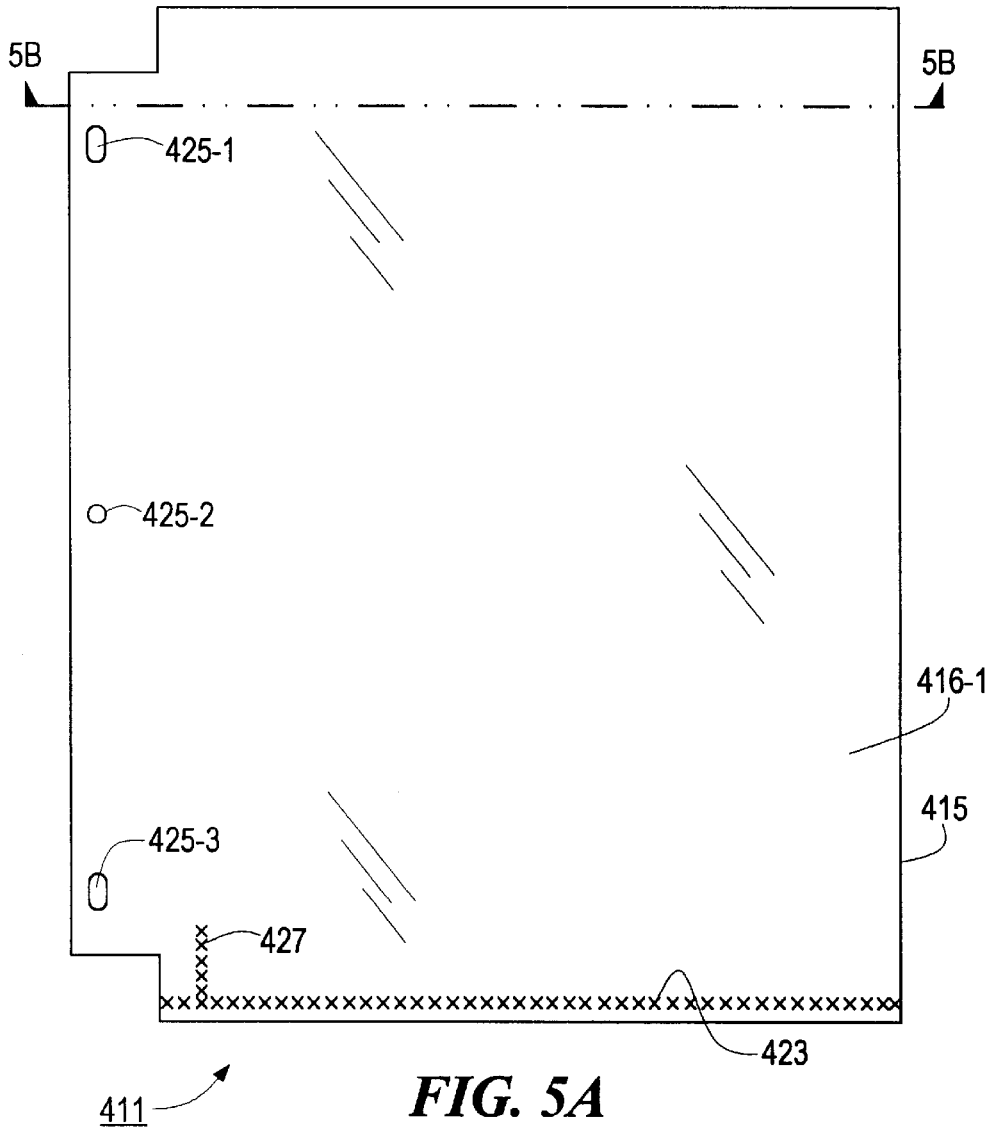
FIG. 5A is a front plan view, broken away in parts, of another embodiment of a sheet protector constructed according to the teachings of the present invention.
Figure 5B:
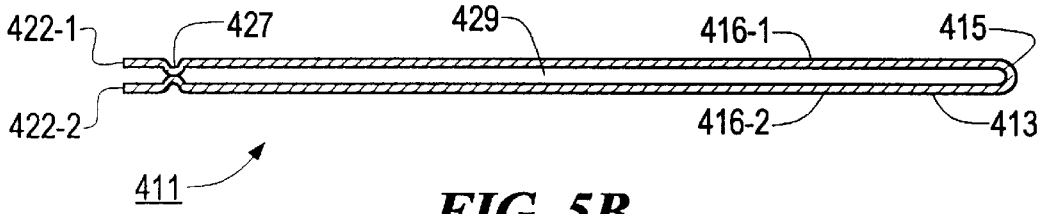
FIG. 5B is a section view of the sheet protector of FIG. 5A, taken along lines 5B—5B in FIG. 5A.
Figure 5C:
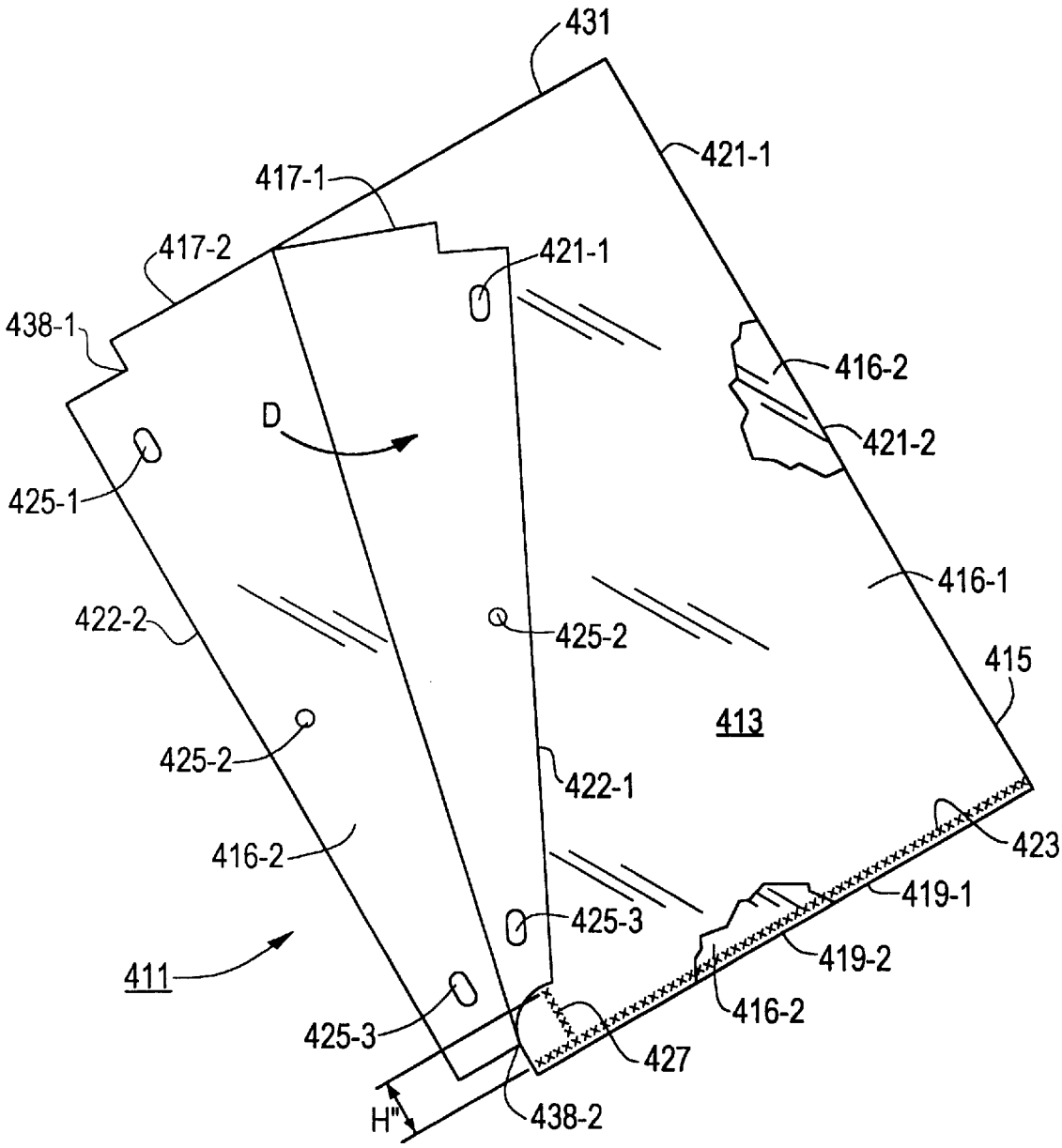
FIG. 5C is a front plan view of the sheet protector shown in FIG. 5A with a portion of the top panel partially folded over.

Referring now to FIGS. 5A through 5C, there is shown another embodiment of a sheet protector constructed according to the teachings of the present invention, the sheet protector being identified generally by reference numeral 411.

Sheet protector 411 comprises a sheet of transparent plastic material 413, such as clear polypropylene, which is folded over on itself about a vertical fold line 415 to form a front panel 416-1 and a rear panel 416-2, panels 416-1 and 416-2 being identical in size and shape. Front panel 416-1 includes a top edge 417-1, a bottom edge 419-1, a right side edge 421-1 which is defined by fold line 415 and a left side edge 422-1. Rear panel 416-2 includes a top edge 417-2, a bottom edge 419-2, a right side edge 421-2 defined by fold line 415 and a left side edge 422-2.

Front panel 416-1 and rear panel 416-2 are secured together along their bottom edges 419-1 and 419-2 by a horizontal weld line 423. Weld line 423 can be formed using conventional welding techniques, such as ultrasonic or heat welding.

Sheet protector 411 further includes a plurality of spaced apart mounting holes 425-1, 425-2 and 425-3 along left side edges 422-1 and 422-2 which extend through front panel 416-1 and rear panel 416-2. Holes 425 enable sheet protector 411 and any documents held therewithin to be mounted on the rings of a binder without having to punch holes into the documents, the holes being spaced from each other so as to align with the rings on the binder with which the sheet protector is to be used. The upper and lower left hand corners 438-1 and 438-2 of sheet protector 411 are notched.

Sheet protector 411 also includes a vertical weld line 427. Vertical weld line 427 secures front panel 416-1 and rear panel 416-2 together in the vicinity of their bottom left corners and serves to create a bottom corner of a pocket 429 between front panel 16-1 and rear panel 416-2, pocket 429 being defined by vertical fold line 415, horizontal weld line 423, top 431 and at the left bottom corner in part by weld line 427.

Vertical weld line 427 is spaced inward from and in parallel with left side edges 422-1 and 422-2. Vertical weld line 427 is shown as extending up a height H" of approximately ¾ of an inch from horizontal weld line 23. However, vertical weld line 53 could, if desired, have a different height while maintaining its functionality. Furthermore, vertical weld line 53 could, if desired, be spaced up vertically from horizontal weld line 423 rather than extend up from horizontal weld line 423 as shown, while maintaining its functionality.

The construction of sheet protector 411 enables front panel 416-1 to be folded open, as shown by arrow D, (when sheet protector 411 is not mounted on the rings of a binder) so as to enable paper documents to be easily inserted into rectangularly shaped pocket 429 from the front of sheet protector 411. This greatly facilitates the ease in which one can insert paper documents into sheet protector 411 when compared to prior art sheet protector 11 which allows for paper documents to be loaded only through open top edge 31. Furthermore, vertical weld line 427 serves to trap paper documents within pocket 429 and thereby prevent the paper documents from slipping out of sheet protector 411 when front panel 416-1 is folded open to insert or remove documents.

The embodiments of the present invention described above are intended to be merely exemplary and those skilled in the art shall be able to make numerous variations and modifications to it without departing from the spirit of the present invention. For example, the present invention is shown sized to hold sheets of 8½" by 11" paper, but could alternatively be constructed to accommodate paper documents of varying sizes. All such variations and modifications are intended to be within the scope of the present invention as defined in the appended claims.

What is claimed is:

1. A sheet protector for holding a paper document, said sheet protector comprising:

(a). a sheet of transparent material which is folded over on itself about a vertical fold line to form a front panel and a rear panel, each of the panels having a top edge, a bottom edge, a right side edge and a left side edge, the vertical fold line defining the right side edge of the front panel and the left side edge of the rear panel, (b). a first weld line for securing together the front and rear panels along their bottom edges, (c). a second weld line for securing together the front and rear panels at a location in close proximity and parallel with the side edges opposite the vertical fold line, (d). the vertical fold line, said first weld line and said second weld line together defining a generally rectangular shaped pocket between the front and rear panels into which the paper document can be inserted, the pocket having an opening along the top edge of the front and rear panels, and (e). a vertical cut line formed on the front panel for enabling a portion of the front panel to be folded open so as to enable said paper document to be easily inserted into said generally rectangularly shaped pocket, said vertical cut line extending down from the top edge of the front panel.

2. The sheet protector as claimed in claim 1 wherein said vertical cut line extends down from the top edge of the front panel in parallel with said second weld line so as to form a generally rectangular portion in the front panel which can be folded open and a thin retaining strip in the front panel which holds the paper document within said sheet protector.

3. The sheet protector as claimed in claim 2 wherein the thin retaining strip has a width in the range of approximately ⅛ of an inch to approximately ⅜ of an inch.

4. The sheet protector of claim 3 wherein said first and second weld lines are formed using ultrasonic welding techniques.

5. The sheet protector as claimed in claim 2 wherein said vertical cut line extends from the top edge of the front panel to said first weld line.

6. The sheet protector of claim 2 further comprising a third weld line spaced apart from and in parallel with said second weld line, said second weld line being positioned between said vertical cut line and said third weld line.

7. The sheet protector as claimed in claim 6 further comprising a plurality of holes formed in the top and bottom panels, said plurality of holes being linearly disposed between said second and third weld lines so as to enable said sheet protector to be mounted onto the rings of a binder.

8. A sheet protector for holding a paper document, said sheet protector comprising:

(a). a sheet of transparent material which is folded over on itself about a vertical fold line to form a front panel and a rear panel, each of the panels having a top edge, a bottom edge, a right side edge and a left side edge, the vertical fold line defining the right side edge of the front panel and the left side edge of the rear panel, (b). a first weld line for securing together the front and rear panels along their bottom edges, (c). a second weld line for securing together the front and rear panels at a location in close proximity and parallel with the side edges opposite the vertical fold line, (d). the vertical fold line, said first weld line and said second weld line together defining a generally rectangular shaped pocket between the front and rear panels into which the paper document can be inserted, the pocket having an opening along the top edge of the front and rear panels, (e). a vertical cut line formed on the front panel for enabling a portion of the front panel to be folded open so as to enable said paper document to be easily inserted into said generally rectangularly shaped pocket, said vertical cut line extending down from the top edge of the front panel, and (f). a third weld line for trapping the paper document within the generally rectangular pocket, said third weld line securing together the front and rear panels at a location between said second weld line and the vertical fold line.

9. The sheet protector as claimed in claim 8 wherein said third weld line extends up from said first weld line in parallel with said second weld line.

10. The sheet protector as claimed in claim 9 wherein said third weld line extends up approximately three-quarters of an inch from said first weld line.

11. A sheet protector for holding a paper document, said sheet protector comprising:

(a). a sheet of transparent material which is folded over on itself about a vertical fold line to form a front panel and a rear panel, each of the panels having a top edge, a bottom edge, a right side edge and a left side edge, the vertical fold line defining the right side edge of the front panel and the left side edge of the rear panel, (b). a first weld line for securing together the front and rear panels along at least a portion of their bottom edges, and (c). a second weld line extending up approximately three-quarters of an inch from said first weld line for trapping the paper document between the front and rear panels, said second weld line securing together the front and rear panels at a location in close proximity and parallel with the side edges opposite the vertical fold line.

12. A sheet protector for holding a paper document, said sheet protector comprising:

(a). a sheet of transparent material which is folded over on itself about a vertical fold line to form a front panel and a rear panel, each of the panels having a top edge, a bottom edge, a right side edge and a left side edge, the vertical fold line defining the right side edge of the front panel and the left side edge of the rear panel, (b). a first weld line for securing together the front and rear panels along at least a portion of their bottom edges, (c). a second weld line extending up approximately three-quarters of an inch from said first weld line for trapping the paper document between the front and rear panels, said second weld line securing together the front and rear panels at a location in close proximity and parallel with the side edges opposite the vertical fold line, and (d). a vertical cut line formed on the front panel for enabling a portion of the front panel to be folded open, said vertical cut line extending down from the top edge of the front panel.

13. The sheet protector as claimed in claim 12 wherein said vertical cut line is spaced apart and parallel with said second weld line, said second weld line being positioned between said vertical cut line and the vertical fold line.

14. The sheet protector as claimed in claim 13 wherein said vertical cut line extends down from the top edge of the front panel, through said second weld line and onto said first weld line.

15. The sheet protector as claimed in claim 14 wherein said vertical cut line separates said second weld line into an inner portion and an outer portion which are disposed on opposite sides of said vertical cut line, the inner portion serving to trap the paper document between the front and rear panels.

16. A sheet protector for holding a paper document, said sheet protector comprising:

(a). a sheet of transparent material which is folded over on itself about a vertical fold line to form a front panel and a rear panel, each of the panels having a top edge, a bottom edge, a right side edge and a left side edge, the vertical fold line defining the right side edge of the front panel and the left side edge of the rear panel, (b). a first weld line for securing together the front and rear panels along their bottom edges, (c). a second weld line for securing together the front and rear panels at a location in close proximity and parallel with the side edges opposite the vertical fold line, said second weld line having a bottom portion of increased thickness, (d). the vertical fold line, said first weld line and said second weld line together defining a generally rectangular shaped pocket between the front and rear panels into which the paper document can be inserted, the pocket having an opening along the top edge of the front and rear panels, and (e). a vertical cut line formed on the front panel for enabling a portion of the front panel to be folded open so as to enable said paper document to be easily inserted into the generally rectangularly shaped pocket, said vertical cut line extending down from the top edge of the front panel, through the bottom portion of said second weld line and onto said first weld line.

17. The sheet protector as claimed in claim 16 wherein said vertical cut line separates the bottom portion of said second weld line into an inner portion and an outer portion which are disposed on opposite sides of said vertical cut line, the inner portion serving to trap the paper document between the front and rear panels.

* * * * *